US010054013B2

(12) United States Patent
Meusel et al.

(10) Patent No.: US 10,054,013 B2
(45) Date of Patent: Aug. 21, 2018

(54) CAMSHAFT COMPRISING AN AXIALLY GUIDED SLIDING ELEMENT

(71) Applicant: ThyssenKrupp Presta TecCenter AG, Eschen (LI)

(72) Inventors: Jürgen Meusel, Dittmannsdorf (DE); Michael Kunz, Chemnitz (DE)

(73) Assignee: THYSSENKRUPP PRESTA TECCENTER AG, Eschen (LI)

( * ) Notice: Subject to any disclaimer, the term of this patent is extended or adjusted under 35 U.S.C. 154(b) by 0 days.

(21) Appl. No.: 15/524,663

(22) PCT Filed: Aug. 3, 2015

(86) PCT No.: PCT/EP2015/067845
§ 371 (c)(1),
(2) Date: May 5, 2017

(87) PCT Pub. No.: WO2016/071015
PCT Pub. Date: May 12, 2016

(65) Prior Publication Data

US 2017/0314425 A1 Nov. 2, 2017

(30) Foreign Application Priority Data

Nov. 7, 2014 (DE) ..... 10 2014 116 256

(51) Int. Cl.
*F01L 1/34* (2006.01)
*F01L 1/047* (2006.01)
*F01L 13/00* (2006.01)

(52) U.S. Cl.
CPC ..... *F01L 1/047* (2013.01); *F01L 13/0036* (2013.01); *F01L 2001/0473* (2013.01); *F01L 2001/0476* (2013.01); *F01L 2013/0052* (2013.01)

(58) Field of Classification Search
CPC ..... F01L 1/047; F01L 2001/0476; F01L 2001/0473; F01L 13/0036; F01L 2013/0052
(Continued)

(56) References Cited

U.S. PATENT DOCUMENTS 7,540,266 B2 * 6/2009 Tsuzuki ..... F01L 1/34 123/90.18

FOREIGN PATENT DOCUMENTS

DE 19519048 A 11/1996
DE 102009014895 B 10/2010
(Continued)

OTHER PUBLICATIONS

English translation of International Search Report issued in PCT/EP2015/067845 dated Oct. 28, 2015 (dated Nov. 5, 2015).
(Continued)

*Primary Examiner* — Ching Chang
(74) *Attorney, Agent, or Firm* — thyssenkrupp North America, Inc.

(57) ABSTRACT

A camshaft may include a shaft on which at least one sliding element is received in such a way as to be axially displaceable along a shaft axis. The shaft may comprise an external longitudinal spline structure that meshes with an internal spline structure of a passage in the sliding element such that the sliding element is arranged in a rotationally fixed manner on the shaft. The sliding element, on its axial end faces, may comprise guiding portions by way of which the sliding element is guided on the shaft to minimize an axial offset of the sliding element. Further, guiding sleeves against which the guiding portions of the sliding element are supported may be received on the shaft.

11 Claims, 2 Drawing Sheets

(58) Field of Classification Search
USPC ..... 123/90.16, 90.18, 90.6; 29/888.1
See application file for complete search history.

(56) References Cited

FOREIGN PATENT DOCUMENTS

| | | | |
|---|---|---|---|
| DE | 102010004591 | A | 7/2011 |
| DE | 102011001711 | A | 10/2012 |
| DE | 102011086161 | A | 5/2013 |

OTHER PUBLICATIONS

English abstract of DE19519048.
English abstract of DE102010004591.

* cited by examiner

CAMSHAFT COMPRISING AN AXIALLY GUIDED SLIDING ELEMENT

CROSS REFERENCE TO RELATED APPLICATIONS

This application is a U.S. National Stage Entry of International Patent Application Serial Number PCT/EP2015/067845, filed Aug. 3, 2015, which claims priority to German Patent Application No. DE 10 2014 116 256.0 filed Nov. 7, 2014, the entire contents of both of which are incorporated herein by reference.

FIELD

The present disclosure generally relates to camshafts, including camshafts with features for minimizing axial offsets of sliding elements disposed on the camshaft.

BACKGROUND

DE 10 2011 086 161 A1 discloses a camshaft with a main shaft, and with a sliding element received on the main shaft in such a way as to be axially displaceable along the shaft axis of the camshaft. The main shaft comprises an external longitudinal spline structure, and the external longitudinal spline structure meshes with an internal spline structure that is introduced into a passage in the sliding element. In this way, the sliding element is axially displaceable on the main shaft in the direction of the shaft axis, and yet the sliding element cannot be rotated on the main shaft, such that torques can be transmitted from the main shaft to the sliding element.

When sliding elements are received on a main shaft provided with an external longitudinal spline structure, the basic problem arises of guiding the sliding element as far as possible without play. In order to ensure that lift information is picked off continuously in a manner free of disturbances from a cam track of the sliding element to a pick-off element, the sliding element must be guided on the main shaft as far as possible without radial play. Guiding the sliding element with minimal play on the main shaft minimizes the axial offset of the sliding element on the main shaft, such that it is desirable for the axial offset to be as small as possible.

To ensure that a guiding of the sliding element on the main shaft is decoupled from the meshing of the external longitudinal spline structure of the main shaft with the internal spline structure in the sliding element, DE 10 2011 086 161 A1 furthermore proposes that guiding portions are provided on the sliding element, by means of which the sliding element is guided on the main shaft so as to minimize the axial offset. The guiding portions on the sliding element in this case run against the tooth tips of the external longitudinal spline structure of the main shaft, as a result of which, however, early wear of the guiding portions may be caused. If cylindrical guiding portions were to be provided on the main shaft, the sliding element could no longer be mounted with the internal spline structure, since the internal spline structure in the passage of the sliding element has a smallest diameter that would be smaller than the cylinder portion for guiding the sliding element on the main shaft. If the guiding portions on the sliding element were to have a smaller diameter and were to sit on a cylinder portion on the main shaft likewise having a smaller diameter, then the sliding element could likewise no longer be mounted, since the external longitudinal spline structure on the main shaft makes it impossible to push on the sliding element with guiding portions of smaller diameter.

DETAILED DESCRIPTION

Figure 1:
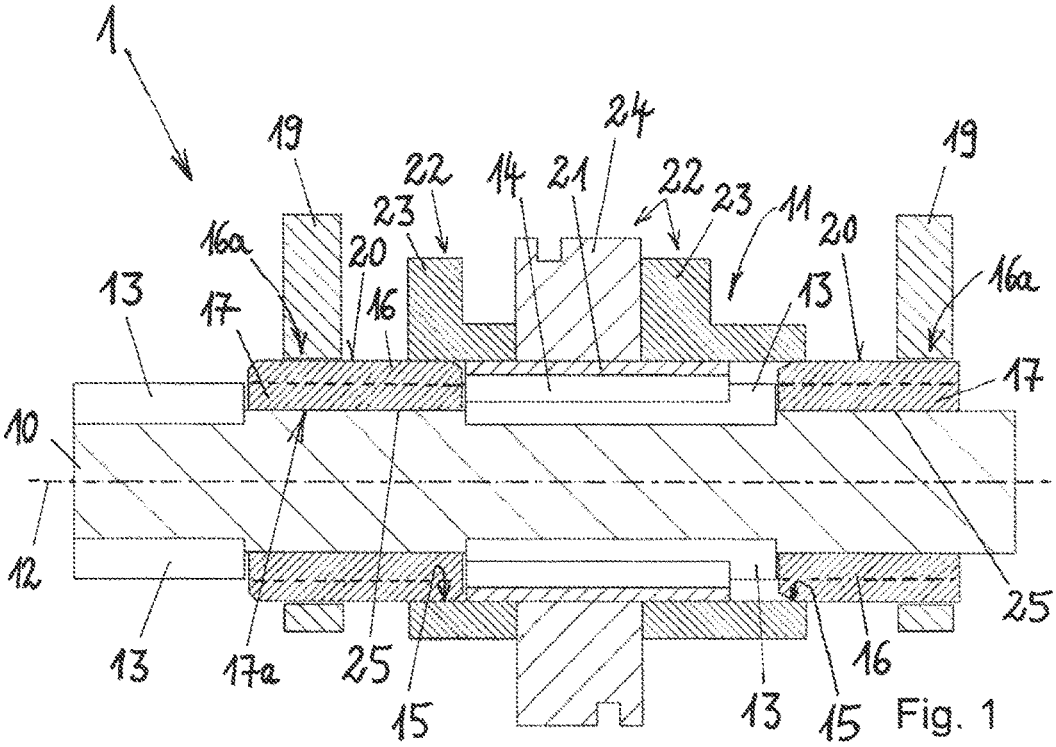
FIG. 1 is a cross-sectional view of an example camshaft, with guiding sleeves that are mounted on receiving portions between an external longitudinal spline structure on a main shaft.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

One example object of the present disclosure is to develop a camshaft with a minimized axial offset of an axially displaceable sliding element on a main shaft, wherein the sliding element is intended to be guided radially against the main shaft via guiding portions. To that end, at least in some examples, the present disclosure concerns a camshaft with a main shaft on which at least one sliding element is received in such a way as to be axially displaceable along a shaft axis, wherein the main shaft comprises an external longitudinal spline structure that meshes with an internal spline structure introduced into a passage in the sliding element, such that the sliding element is arranged in a rotationally fixed manner on the main shaft, and wherein the sliding element, on its axial end faces, comprises guiding portions by means of which the sliding element is guided on the main shaft in order to minimize an axial offset of the sliding element.

Proceeding from a camshaft according to the preamble of claim 1, this object is achieved in conjunction with the characterizing features. Advantageous developments of the invention are set out in the dependent claims.

To achieve the above object, the invention includes the technical teaching that guiding sleeves are received on the main shaft, and the guiding portions of the sliding element are supported against these.

The invention is based on the general concept of being able to design the geometry of the external longitudinal spline structure on the main shaft and of the internal spline structure in the passage of the sliding element in a manner known per se, but with the separate guiding sleeves according to the invention permitting guiding of the sliding element without the guiding portions needing to have a diameter smaller than the greatest diameter of the external longitudinal spline structure. In this way, the sliding element can be guided via the guiding portions against a cylindrical outer circumferential surface. Mounting of the camshaft is then performed in a simple way, since first of all the sliding element can be placed on the main shaft, and only then can the guiding sleeves or at least one final guiding sleeve be arranged on the main shaft laterally with respect to the sliding element.

The guiding sleeves can, for example, have an internal diameter that corresponds to the tip diameter of the external longitudinal spline structure. The guiding sleeves can thus be mounted on the tooth tips of the external longitudinal spline structure. The guiding sleeves can particularly advantageously comprise an internal spline structure, and the internal spline structure in the guiding sleeves can be configured such that it can sit on the external longitudinal spline structure of the main shaft, such that teeth of the internal spline structure fit in tooth interstices of the teeth of the external longitudinal spline structure. The dimensioning of the internal spline structure of the guiding sleeves can be such that the guiding sleeves can be mounted fixedly on the external longitudinal spline structure.

Particularly advantageously, the guiding sleeves can be shrink-fitted or pressed onto the main shaft. For example, the guiding sleeves can be heated and/or the main shaft can be cooled, such that the guiding sleeves can be mounted on the main shaft in the manner of a transverse interference fit. It is likewise conceivable that the guiding sleeves can be pressed onto the main shaft in the direction of the shaft axis in order to create a longitudinal interference fit.

Two guiding sleeves can be provided in order to guide one sliding element, and, seen in the direction of the shaft axis, the guiding sleeves can be arranged on the man shaft laterally with respect to the area of meshing of the external longitudinal spline structure in the internal spline structure. The guiding sleeves can be spaced apart from each other by a distance that allows the sliding element to be moved axially on the main shaft, in order to operatively connect different cam tracks to a pick-off element for valve actuation. In particular, the guiding portions of the sliding element can be configured with such an axial overlap with the guiding sleeves that an axial displacement of the sliding element is permitted while maintaining the guiding of the guiding portions on the guiding sleeves.

The guiding sleeves can be mounted on the main shaft in different ways. For example, the external longitudinal spline structure can be designed free of interruptions along the shaft axis, such that the internal spline structure of the guiding sleeves can be made to mesh with the external longitudinal spline structure independently of a position along the shaft axis. The external longitudinal spline structure is designed as unchanging in the axial direction, and the external longitudinal spline structure can have the same configuration in the area of placement of the guiding sleeves as in the area in which the external longitudinal spline structure meshes with the internal spline structure in the passage of the sliding element. In this way, the production of the main shaft is made easier, particularly if the external longitudinal spline structure does not need to have sections differing from each other along the shaft axis.

Alternatively, provision can be made that the external longitudinal spline structure comprises cylindrical receiving portions, such that the main shaft has cylindrical portions alternating with the external longitudinal spline structure. The internal spline structure of the guiding sleeves with tooth tips configured thereon can sit on the cylindrical receiving portion. However, the internal spline structure in the guiding sleeves remains necessary, since otherwise the guiding sleeves could not be guided over the adjacent external longitudinal spline structure on the main shaft. For example, the cylindrical receiving portion on the main shaft can have a diameter which, for example, is slightly greater than the diameter of the root diameter of the external longitudinal spline structure.

Moreover, for the rotatably movable support, the main shaft and with it the camshaft can be arranged in bearing brackets. The bearing brackets can be part of the cylinder head of an internal combustion engine or a constituent part of a hood module in which one or more camshafts are received. The guiding sleeves can in this case have a longitudinal portion which forms a bearing inner ring for supporting in the bearing bracket. According to the invention, the guiding sleeves can thus be used not only for the radial guiding of the axial movement of the sliding elements; the guiding sleeves can at the same time also form bearing rings which, with the bearing brackets, form plain bearing arrangements for supporting the camshaft.

For example, the guiding sleeves can have a cylindrical outer circumferential surface against which the guiding portions of the sliding element and at the same time also the bearing bracket are supported or received. In particular, the external longitudinal spline structure of the main shaft can comprise interruption sections among the longitudinal portions of the guiding sleeves which, with the bearing brackets, form the plain bearing arrangement. By means of the interruption sections, no interference fit of the internal spline structure of the guiding sleeves with the external longitudinal spline structure of the main shaft is generated, such that the concentricity of the outer circumferential surface is not adversely affected by the interference fit of the internal spline structure with the external longitudinal spline structure of the main shaft. Otherwise, the multiple bearing of the guiding sleeves under the plain bearing arrangement with the bearing brackets via the tooth tips of the internal spline structure could impress a polygonal structure into the guiding sleeves that negatively influences the concentricity.

Sliding elements can be designed with a carrier tube on which several functional elements are mounted. The functional elements can, for example, form cam elements or an adjustment member, and the adjustment member serves for the axial adjustment of the sliding element on the main shaft and can interact with an adjustment manipulator arranged stationary in the installation space of the camshaft. For example, the carrier tube can be made so long that the functional elements protrude laterally beyond the carrier tube, and the guiding portions can be configured internally on at least one functional element. For example, the functional elements, in particular the cam elements, can be mounted on the outside of the carrier tube via a cylindrical interference fit and protrude laterally beyond the carrier tube. The protruding part of the functional element in this case frees an inner cylindrical portion which forms the guiding portion and, with the outer circumferential surface of the guiding sleeves, forms the radial guiding thereof.

FIG. 1 shows part of a camshaft 1 according to a first embodiment of the invention. The camshaft 1 comprises a main shaft 10, which extends along a shaft axis 12. A sliding element 11, which is axially displaceable along the shaft axis 12, is received on the main shaft 10. The camshaft 1 in principle comprises several sliding elements 11, which can each preferably be received in the same way on the main shaft 10. In order to mount the camshaft 1 in a cylinder head, for example, or in a module hood, bearing brackets 19 are provided, and the camshaft 1 is received, rotatably about the shaft axis 12, in two bearing brackets 19, for example.

The main shaft 10 comprises an external longitudinal spline structure 13, wherein the external longitudinal spline structure 13 is shown interrupted several times along the shaft axis 12.

The sliding element 11 comprises a carrier tube 21, and an internal spline structure 14 is formed in the internal passage of the carrier tube 21. The internal spline structure 14 meshes with the external longitudinal spline structure 13 of the main shaft 10, such that the sliding element 11 is received on the main shaft 10 in such a way as to be fixed in rotation but displaceable along the shaft axis 12. The tolerance or dimensioning of the external longitudinal spline structure 13 in relation to the internal spline structure 14 is provided such that only the torque transmission is ensured, and a radial guiding with a minimal axial offset of the sliding element 11 on the main shaft 10 is effected via the meshing between the external longitudinal spline structure 13 and the internal spline structure 14.

For the radial guiding of the sliding element 11, guiding portions 15 are formed on the latter, and the guiding portions 15 run against guiding sleeves 16 which are received on the main shaft 10. In this way, the guiding sleeves 16 support the sliding element 11 via the guiding portions 15.

The guiding portions 15 are formed on functional elements 22, which are received on the carrier tube 21. In this connection, the embodiment shows a sliding element 11 with two functional elements 22, which are designed as cam elements 23 with different cam tracks. Situated between the two illustrated cam elements 23 there is an adjustment member 24, via which the sliding element 11 can be displaced on the main shaft 10 in the direction of the shaft axis using a manipulator (not shown). The sliding element 11 is shown in a leftward position with respect to the drawing plane, such that the guiding portion 15 shown on the left has a greater overlap with the left-hand guiding sleeve 16 than the guiding portion 15 shown on the right has with the right-hand guiding sleeve 16. The two guiding sleeves 16 are arranged in the carrier tube 21 adjacent to the meshing of the external longitudinal spline structure 13 with the internal spline structure 14, wherein the distance between the two guiding sleeves 16 is such that the axial mobility of the sliding element 11 is still ensured.

The guiding sleeves 16 comprise an internal spline structure 17, wherein the internal spline structure 17 is designed such that it can be guided beyond the external longitudinal spline structure 13 of the main shaft 10 in the direction of the shaft axis. The embodiment shows the main shaft 10 with interruptions in the external longitudinal spline structure 13, such that seats for receiving the guiding sleeves 16 are formed by cylindrical receiving portions 25. The guiding sleeves 16 sit with their tooth tips 17*a* of the internal spline structure 17 on the cylindrical receiving portions 25, and the guiding sleeves 16 can be shrink-fitted or pressed onto the receiving portions 25. For example, the diameter of the receiving portions 25 can be dimensioned such that it is slightly greater than the root diameter of the external longitudinal spline structure 13 of the main shaft 10. In this way, the guiding sleeves 16 can be guided over the external longitudinal spline structure 13 to the seats which are formed by the receiving portions 25. When the guiding sleeves 16 reach the receiving portions 25, the pressing with the main shaft 10 is obtained by way of a longitudinal interference fit or a transverse interference fit.

The guiding sleeves 16 is of a length which is defined such that the guiding sleeves 16 extend with a longitudinal portion 16*a* to below or into the bearing brackets 19. In this way, the guiding sleeves 16 form, with their outer circumferential surface 20, a plain bearing arrangement with the bearing brackets 19, such that the camshaft 1 can be mounted rotatably about the shaft axis 12 via the guiding sleeves 16. The guiding sleeves 16 thus perform both a guiding function of the sliding element 11 via the guiding portions 15 formed on the sliding element 11 and also a bearing function for supporting the camshaft 1 in the bearing brackets 19. The outer circumferential surface 20 of the guiding sleeves 16 can be dimensioned and surface-finished such that the guiding sleeves 16 can serve as bearing inner rings for the plain bearing in the bearing brackets 19.

Figure 2:
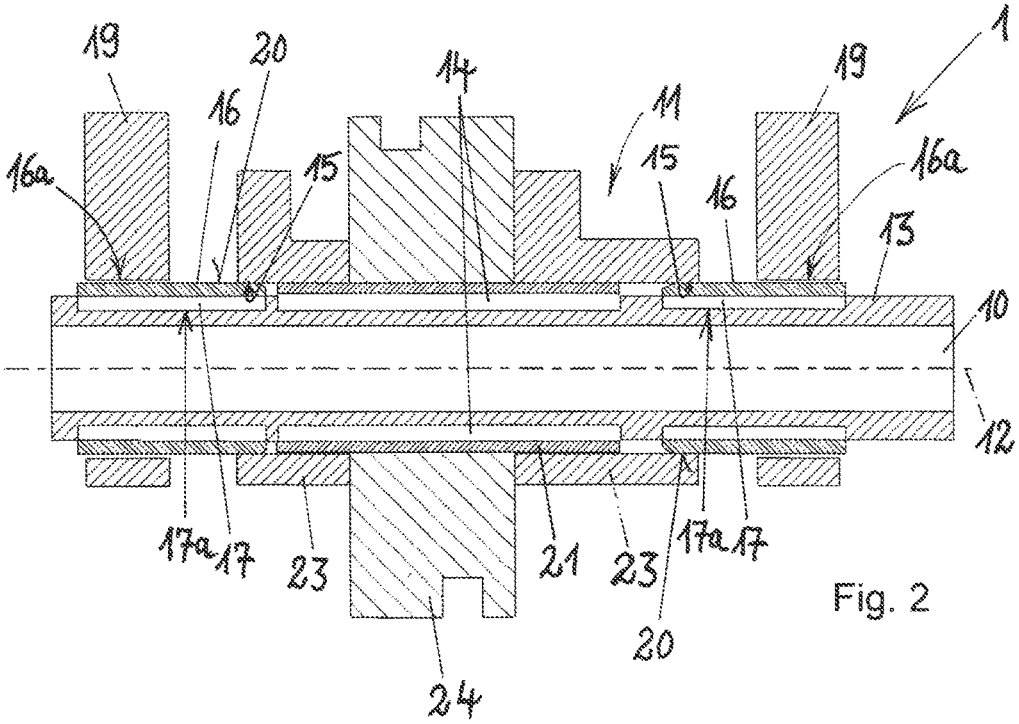
FIG. 2 is cross-sectional view of another example camshaft, with guiding sleeves that sit on a continuous external longitudinal spline structure of a main shaft.

FIG. 2 shows a modified embodiment of the camshaft 1 with a main shaft 10 which is hollow, for purposes of weight reduction, and which extends along a shaft axis 12. A sliding element 11 is received on the main shaft 10, and the sliding element 11 comprises a carrier tube 21 which receives two cam elements 23 and an adjustment member 24. On the inside, the carrier tube 21 comprises an internal spline structure 14, which meshes with an external longitudinal spline structure 13 of the main shaft 10. As has already been described with reference to FIG. 1, the sliding element 11 is in this way received on the main shaft 10 in such a way as to be axially movable thereon but fixed in rotation.

The main shaft 10 is formed with an external longitudinal spline structure 13 which is continuous along the shaft axis 12, such that said external longitudinal spline structure 13 is free of interruptions and all the elements are received on the external longitudinal spline structure 13 itself. Laterally with respect to the arrangement of the sliding element 11, guiding sleeves 16, which have an internal spline structure 17 on the inside, are received on the external longitudinal spline structure 13 of the main shaft 10. This internal spline structure 17 meshes with the external longitudinal spline structure 13 of the main shaft 10, and the internal spline structure 17 is dimensioned such that it is pressed onto the external longitudinal spline structure 13 of the main shaft 10 by way of a transverse interference fit or longitudinal interference fit. In particular, tooth tips 17*a* of the internal spline structure 17 are shown via which the guiding sleeve 16 can be pressed onto the external longitudinal spline structure 13, for example by means of the tooth tip dimension of the internal spline structure 17 being greater (i.e. with smaller tip diameter) than the tooth root dimension of the external longitudinal spline structure 13.

The embodiment shows guiding sleeves 16 with a longitudinal portion 16*a* which extends into the bearing brackets 19, such that the guiding sleeves 16, with the bearing brackets 19, form a plain bearing arrangement of the camshaft 1.

Guiding portions 15 are formed internally in the cam elements 23 and are guided on the outer circumferential surface 20 of the guiding sleeves 16, thereby providing the radial guiding of the sliding element 11. The guide extent between the guiding portions 15 and the outer circumferential surface 20 of the guiding sleeves 16 can be defined such that a minimum axial offset of the sliding element 11 on the main shaft 10 is obtained.

Figure 3:
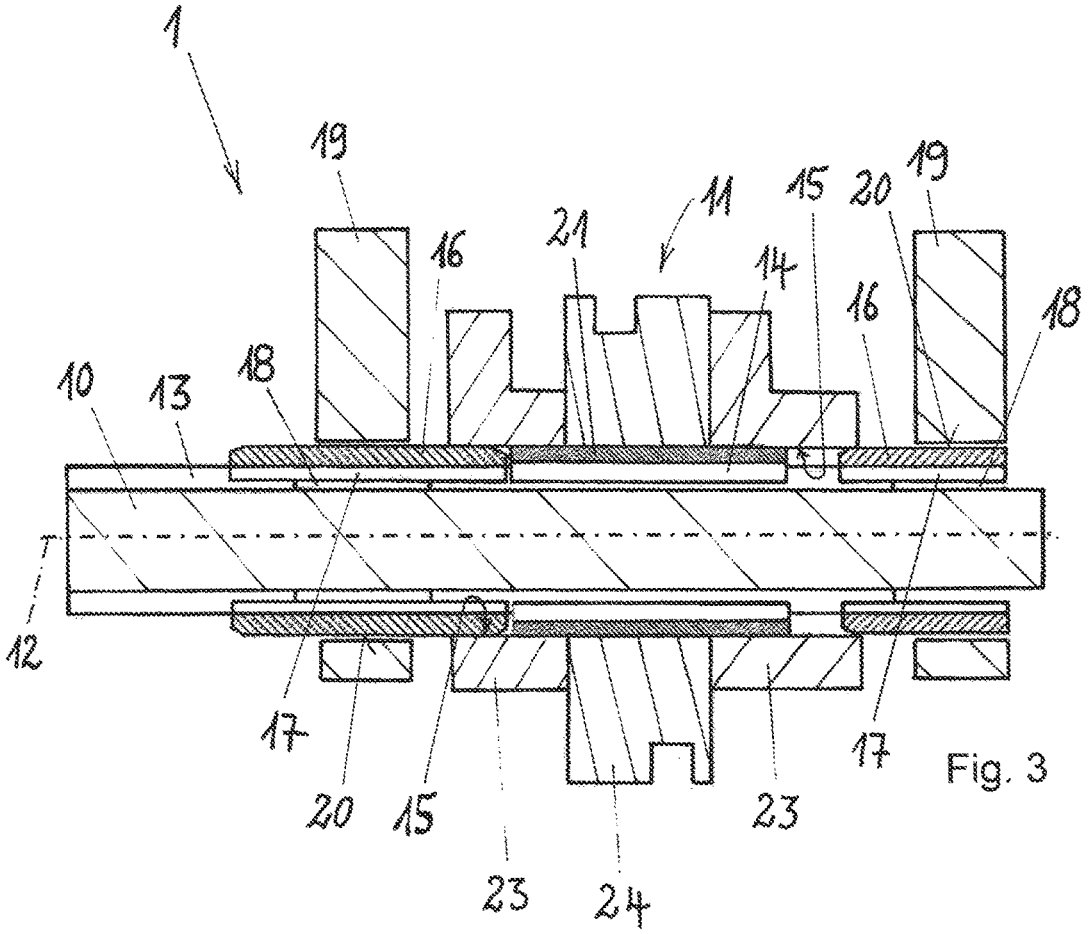
FIG. 3 is a cross-sectional view of still another example camshaft, with guiding sleeves that sit on an external longitudinal spline structure of a main shaft, wherein the external longitudinal spline structure comprises an interruption section.

FIG. 3, finally, shows another modified embodiment of the camshaft 1 with a main shaft 10 that comprises interruption sections 18. The guiding sleeves 16 are arranged on the main shaft 10 at positions along the shaft axis 12 where the interruption sections 18 are located. The interruption sections 18 here correspond to the bearing brackets 19 for rotatably receiving the camshaft 1 via the guiding sleeves 16, and the guiding sleeves 16, via their outer circumferential surface 20, serve to support the camshaft 1 in the bearing brackets 19.

The guiding sleeves 16 are longer than the width of the interruption sections 18 in the direction of the shaft axis, such that the guiding sleeves 16 on their outsides are mounted on the external longitudinal spline structure 13 of the main shaft 10, in particular pressed on. The section over which the bearing brackets 19 form a plain bearing with the outer circumferential surface 20 of the guiding sleeves 16 thus has no interference fit of the internal spline structure 17 of the guiding sleeves 16 with the external longitudinal spline structure 13 of the main shaft 10, such that the concentricity of the outer circumferential surface 20 is not adversely affected by the pressing action of the internal spline structure 17 in the external longitudinal spline structure 13 of the main shaft 10.

The sliding element 11 is guided on the guiding sleeves 16, in the manner described above, via the guiding portions 15 which are formed on cam elements 23 that are received on a carrier tube 21 of the sliding element 11. Between the two cam elements 23 there is an adjustment member 24 for axially adjusting the sliding element along the shaft axis 12 on the main shaft 10. For the torque transmission between the main shaft 10 and the sliding element 11, an internal spline structure 14 is used which is incorporated internally in the carrier tube 21 and which interacts with the external longitudinal spline structure 13.

The invention is not limited in terms of its design to the preferred embodiment described above. Rather, numerous variants are conceivable which make use of the presented solution even in fundamentally different embodiments. All of the features and/or advantages that emerge from the claims, from the description or from the drawings, including design details or spatial arrangements, may be essential to the invention both individually and in a wide variety of combinations.

LIST OF REFERENCE SIGNS

1 camshaft
10 main shaft
11 sliding element
12 shaft axis
13 external longitudinal spline structure
14 internal spline structure
15 guiding portion
16 guiding sleeve
16*a* longitudinal portion
17 internal spline structure
17*a* tooth tip
18 interruption section
19 bearing bracket
20 outer circumferential surface
21 carrier tube
22 functional element
23 cam element
24 adjustment member
25 receiving portion

What is claimed is:

1. A camshaft comprising:

a sliding element that comprises a passage with an internal spline structure, wherein axial end faces of the sliding element comprise guiding portions; and a shaft that receives the sliding element such that the sliding element is axially displaceable along a shaft axis, wherein the shaft comprises an external longitudinal spline structure that meshes with the internal spline structure of the sliding element such that the sliding element is rotationally fixed on the shaft, wherein the sliding element is configured to be guided on the shaft by way of the guiding portions to minimize an axial offset of the sliding element with respect to the shaft, wherein the guiding portions of the sliding element are configured to be supported against guiding sleeves of the shaft.

2. The camshaft of claim 1 wherein the guiding sleeves are shrink-fitted or pressed onto the shaft.

3. The camshaft of claim 1 wherein the guiding sleeves, seen in a direction of the shaft axis, are disposed on the shaft laterally with respect to an area of engagement of the external longitudinal spline structure in the internal spline structure.

4. The camshaft of claim 1 wherein the guiding sleeves comprise an internal spline structure, wherein the external longitudinal spline structure is free of interruptions along the shaft axis such that the internal spline structure of the guiding sleeves can mesh with the external longitudinal spline structure independent of a position along the shaft axis.

5. The camshaft of claim 1 wherein the guiding sleeves comprise an internal spline structure.

6. The camshaft of claim 5 wherein the external longitudinal spline structure comprises cylindrical receiving portions, wherein the internal spline structure of the guiding sleeves sits on the cylindrical receiving portions via tooth tips formed on the internal spline structure of the guiding sleeves.

7. The camshaft of claim 1 wherein the shaft is disposed rotationally movably in a bearing bracket, wherein the guiding sleeves comprise a longitudinal portion that forms a bearing inner ring for mounting the shaft in the bearing bracket.

8. The camshaft of claim 7 wherein at least one of the guiding sleeves comprise a cylindrical outer circumferential surface against which the guiding portions of the sliding element are supported, or the external longitudinal spline structure of the shaft comprises interruption sections among the longitudinal portions of the guiding sleeves, wherein the interruption sections with the bearing bracket forms a plain bearing arrangement.

9. The camshaft of claim 7 wherein at least one of the guiding sleeves comprise a cylindrical outer circumferential surface against which the guiding portions of the sliding element and the bearing bracket are supported, or the external longitudinal spline structure of the shaft comprises interruption sections among the longitudinal portions of the guiding sleeves, wherein the interruption sections with the bearing bracket form a plain bearing arrangement.

10. The camshaft of claim 1 wherein the guiding portions of the sliding element are configured to axially overlap the guiding sleeves such that axial displacement of the sliding element is permitted while maintaining guiding of the guiding portions on the guiding sleeves.

11. The camshaft of claim 1 wherein the sliding element comprises a carrier tube on which functional elements of the sliding element are received, wherein the guiding portions are disposed on at least one of the functional elements.

* * * * *